US010508470B2

(12) United States Patent
Raatikainen

(10) Patent No.: US 10,508,470 B2
(45) Date of Patent: Dec. 17, 2019

(54) LOCK BODY

(71) Applicant: Abloy Oy, Joensuu (FI)

(72) Inventor: Juha Raatikainen, Kontiolahti (FI)

(73) Assignee: Abloy OY, Joensuu (FI)

( * ) Notice: Subject to any disclaimer, the term of this patent is extended or adjusted under 35 U.S.C. 154(b) by 342 days.

(21) Appl. No.: 15/556,413

(22) PCT Filed: Apr. 14, 2016

(86) PCT No.: PCT/FI2016/050248
§ 371 (c)(1),
(2) Date: Sep. 7, 2017

(87) PCT Pub. No.: WO2016/170228
PCT Pub. Date: Oct. 27, 2016

(65) Prior Publication Data

US 2018/0106075 A1 Apr. 19, 2018

(30) Foreign Application Priority Data

Apr. 21, 2015 (FI) ..... 20155295

(51) Int. Cl.
*E05B 47/06* (2006.01)
*E05B 47/00* (2006.01)

(52) U.S. Cl.
CPC ..... *E05B 47/0676* (2013.01); *E05B 47/0012* (2013.01); *E05B 2047/0017* (2013.01)

(58) Field of Classification Search
CPC ..... E05B 47/0012; E05B 2047/002; E05B 2047/0031; E05B 2047/0023; E05B 47/026; E05B 2047/0058; E05B 47/0673; E05B 47/068; E05B 17/2038; E05B 47/0001; Y10T 292/1021; Y10T 70/7113;
(Continued)

(56) References Cited

U.S. PATENT DOCUMENTS 4,800,741 A * 1/1989 Kerschenbaum ... E05B 47/0002 292/1.5
4,949,563 A * 8/1990 Gerard ..... E05B 47/026 292/144
(Continued)

FOREIGN PATENT DOCUMENTS

CN 2030642 U 1/1989
CN 101324163 A 12/2008
(Continued)

OTHER PUBLICATIONS

Chinese Office Action issued in corresponding Chinese Patent Application No. 201680023274.X dated Nov. 2, 201 with English Language Translation.

*Primary Examiner* — Mark A Williams
(74) *Attorney, Agent, or Firm* — Muncy, Geissler, Olds & Lowe, P.C.

(57) ABSTRACT

The invention relates to a lock body having an electric motor. The electric motor is arranged to guide the forming and removing of a force transmission connection between the parts to be arranged in the force transmission connection to transfer force or to impede force transfer. If formation of the force transmission connection is not achieved, the construction of the invention is such that the use of one spring enables the pushing of the piston connected to the electric motor both outwards and inwards.

9 Claims, 7 Drawing Sheets

Figure 1:
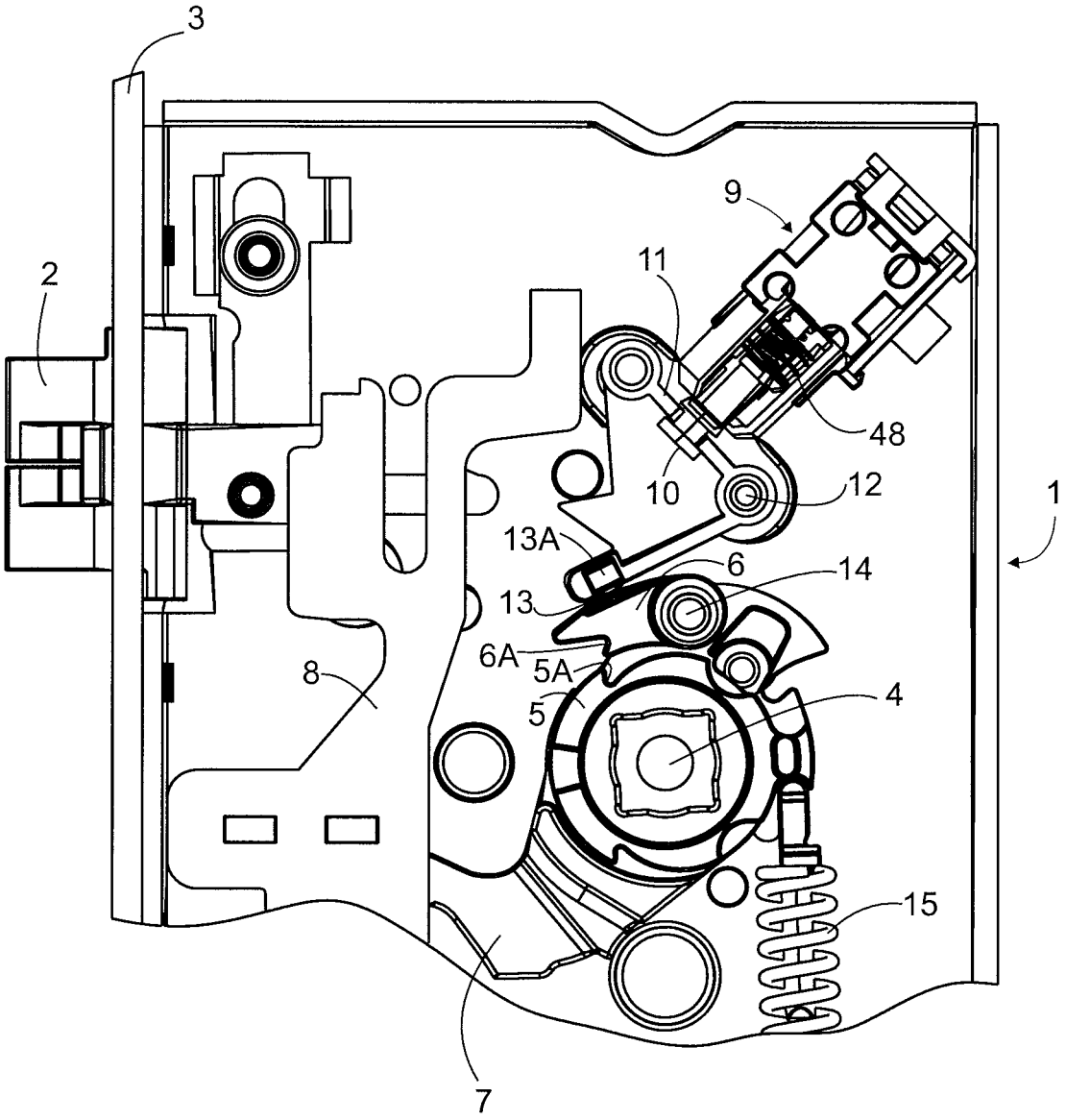

(58) Field of Classification Search
CPC ..... Y10T 292/1082; Y10T 292/1018; Y10T 292/1079; Y10T 70/7062; Y10T 292/699; Y10S 292/51
See application file for complete search history.

(56) References Cited

U.S. PATENT DOCUMENTS

| | | | | |
|---|---|---|---|---|
| 9,316,025 | B2 * | 4/2016 | Lien | E05B 47/0012 |
| 2003/0061849 | A1 * | 4/2003 | Yeh | E05B 47/0012 70/279.1 |
| 2004/0061339 | A1 | 4/2004 | Lemettinen | |
| 2005/0050928 | A1 | 3/2005 | Frolov et al. | |
| 2005/0092046 | A1 * | 5/2005 | Errani | E05B 47/0692 70/283 |
| 2005/0199026 | A1 | 9/2005 | Geringer et al. | |
| 2006/0137414 | A1 * | 6/2006 | Denison | E05B 47/0012 70/257 |
| 2008/0303290 | A1 | 12/2008 | Yuan | |
| 2009/0007613 | A1 * | 1/2009 | Spycher | E05B 47/063 70/278.7 |
| 2009/0173120 | A1 * | 7/2009 | Lin | E05B 17/0058 70/279.1 |
| 2009/0178449 | A1 * | 7/2009 | Raatikainen | E05B 47/0012 70/263 |
| 2010/0212381 | A1 * | 8/2010 | Huang | E05B 47/068 70/279.1 |
| 2013/0033045 | A1 * | 2/2013 | Worm | E05B 65/0075 292/5 |
| 2013/0305792 | A1 * | 11/2013 | Lien | E05B 47/0012 70/278.7 |
| 2016/0060904 | A1 * | 3/2016 | Dore Vasudevan | E05B 47/0673 292/144 |

FOREIGN PATENT DOCUMENTS

| | | | |
|---|---|---|---|
| CN | 103422724 | A | 12/2013 |
| CN | 103541611 | A | 1/2014 |
| DE | 198 54 454 | A1 | 6/2000 |
| WO | WO 2005/042886 | A1 | 5/2005 |
| WO | WO 2008/132275 | A2 | 11/2008 |

* cited by examiner

LOCK BODY

TECHNICAL FIELD

The invention relates to a lock body having an electric motor to guide the forming and removing of a force transmission connection between the parts to be arranged in the force transmission connection to transfer force or to impede force transfer. The force transfer can be, for example, from a handle to be connected to the lock body, via a so-called driver to the locking parts of the bolt or from the bolt to the deadbolting piece in the lock body.

PRIOR ART

The common operational arrangement of a lock body is the kind that the door is always to be opened from the outside by a key-operated lock mechanism, and from the inside by a handle, rotary knob or equivalent. Additionally, the lock body can be a lock body to be opened from the outside electronically, in which case an electric motor guides to form a force transmission connection, wherein turning the outside handle releases the locking parts of the bolt of the lock body, allowing movement of the bolt inside the lock body. In another type of lock body, turning of the handle pulls the bolt into the lock body. There are also other operational arrangements of a lock body. It is possible that the lock body is from the outside to be opened only electronically or that the lock body is opened from both sides electronically.

Guiding the handle function in the lock of a door by an electric motor can, depending on the application, be achieved in different ways. The arrangement can, for example, be such that, when current is connected to the electric motor, the rotation of its axis in the first direction allows the door to be opened by the handle, wherein force transmission from the handle to the locking parts of the bolt of the lock is thus coupled. Alternatively, the solution can be inverse such that the arrangement allows the door to be opened by the handle as the electric motor is rotated in the other direction, i.e. in a rotational direction opposite to the first direction. Selection of the rotational direction of the electric motor depends on the embodiment of the lock body.

The lock body usually has a pressure cam positioned at the spindle axis of the handle and drivers on both sides of the pressure cam. The driver is in connection with the spindle of the handle, which is connected to the lock body from the side of the respective driver. The driver on the opposite side of the lock body is correspondingly to be connected to the spindle of the handle on the opposite side. The driver can be connected to the force transfer connection along with the pressure cam by the latch, wherein the spindle of the handle is via the driver and the latch in a force transfer connection with the pressure cam. The pressure cam is, in turn, in connection with the locking parts of the bolt of the lock body. The electric motor guides the latch to form a force transfer connection or to remove the force transfer connection. The force transmission connection created by the guiding of the electric motor allows the bolt to move inside the lock body. When the locking parts of the bolt are in the locking position, the bolt is not able to move into the lock body. The bolt is able to move into the lock body only when the locking parts are moved out of the locking position.

If the handle is turned, even though a force transfer connection is not achieved, the handle turns but the pressure cam and thus the bolt do not move. The bolt is thus not able to move towards the lock body. If the handle is pressed, while the electric motor guides the latch to form a force transfer connection, force transfer is not formed. For such a situation, there can be a spring system in connection with the electric motor arrangement. If the pressing of the handle is stopped in such a situation, the spring system guides the latch into the desired force transfer connection, even if the guiding of the electric motor were to have already terminated.

One known electric motor arrangement on the market comprises, in addition to an electric motor, an installation rack, which is attached to the lock body and into which the electric motor is placed. Onto the axis of the electric motor is attached a worm screw. The arrangement further comprises a threaded counterpart and a piston. The threaded counterpart is against the worm screw and movable by the electric motor in the direction of the axis of the electric motor. The threaded counterpart is in connection with the piston, which thus can be moved from the electric motor outwards or towards the electric motor. The electric motor arrangement also has above said spring system, which is comprised of two springs. The first spring is arranged to push the piston outwards and the second spring is arranged to push the piston inwards, i.e. towards the electric motor. The piston is in connection with above said latch, for example, through a lever, levers or a plate.

By using two springs, an action is created, which assures the movement of the latch into the force transfer connection and out from the force transfer connection. The springs are placed around the axis of the electric motor such that the worm screw is between the springs. Installation of the screws requires precision, as the springs are relatively small. Additionally, it is difficult to reach a balance between the springs, wherein the forces of the springs are as equal as possible.

BRIEF DESCRIPTION OF THE INVENTION

The object of the invention is to provide better installability of an electric motor arrangement of a lock body, wherein the production costs of the lock body are also reduced.

The invention is based on the idea that it is possible to use only one spring, which replaces the known use of two springs. The construction of the invention is such that the use of one spring is possible such that it pushes the piston outwards or inwards.

A lock body according to the invention comprises a bolt and parts to be arranged in a force transmission connection. The lock body further comprises an electric motor, which is arranged to guide the forming and removing of a force transmission connection between said parts to transfer force or to impede force transfer from the spindle axis of the handle to the locking parts of the bolt.

The lock body has, attached to it, an installation rack, into which the electric motor is placed. The electric motor has an axis, to which is attached a worm screw. The lock body further comprises a threaded counterpart and a piston. The threaded counterpart is against the worm screw and movable by the electric motor in the direction of the axis of the electric motor, and the piston is in connection with the counterpart.

The counterpart has at least two vanes facing away from the electric motor, at both ends of which vanes are vane projections of the counterpart facing away from the axis of the electric motor. The piston has at least two vanes of the piston facing towards the electric motor, at both ends of which vanes of the piston are projections of the vanes of the piston facing away from the axis of the electric motor. The vanes of the counterpart and the vanes of the piston are overlapping and surrounded by a spring, which is further between the vane projections of the counterpart and the vane projections of the piston.

The piston is arranged to move in the direction of the axis of the electric motor, sliding in relation to the counterpart and, at the same time, the vanes of the counterpart. The spring is arranged to store potential energy during the guiding state of the electric motor, wherein the movement of the piston is at least partially impeded. When the piston is able to move, once the impediment to movement of the piston having terminated, potential energy either pushes the piston away from the electric motor or towards the electric motor depending on the embodiment of said lock body and thus also that of the electric motor installation.

LIST OF FIGURES

Figure 2:
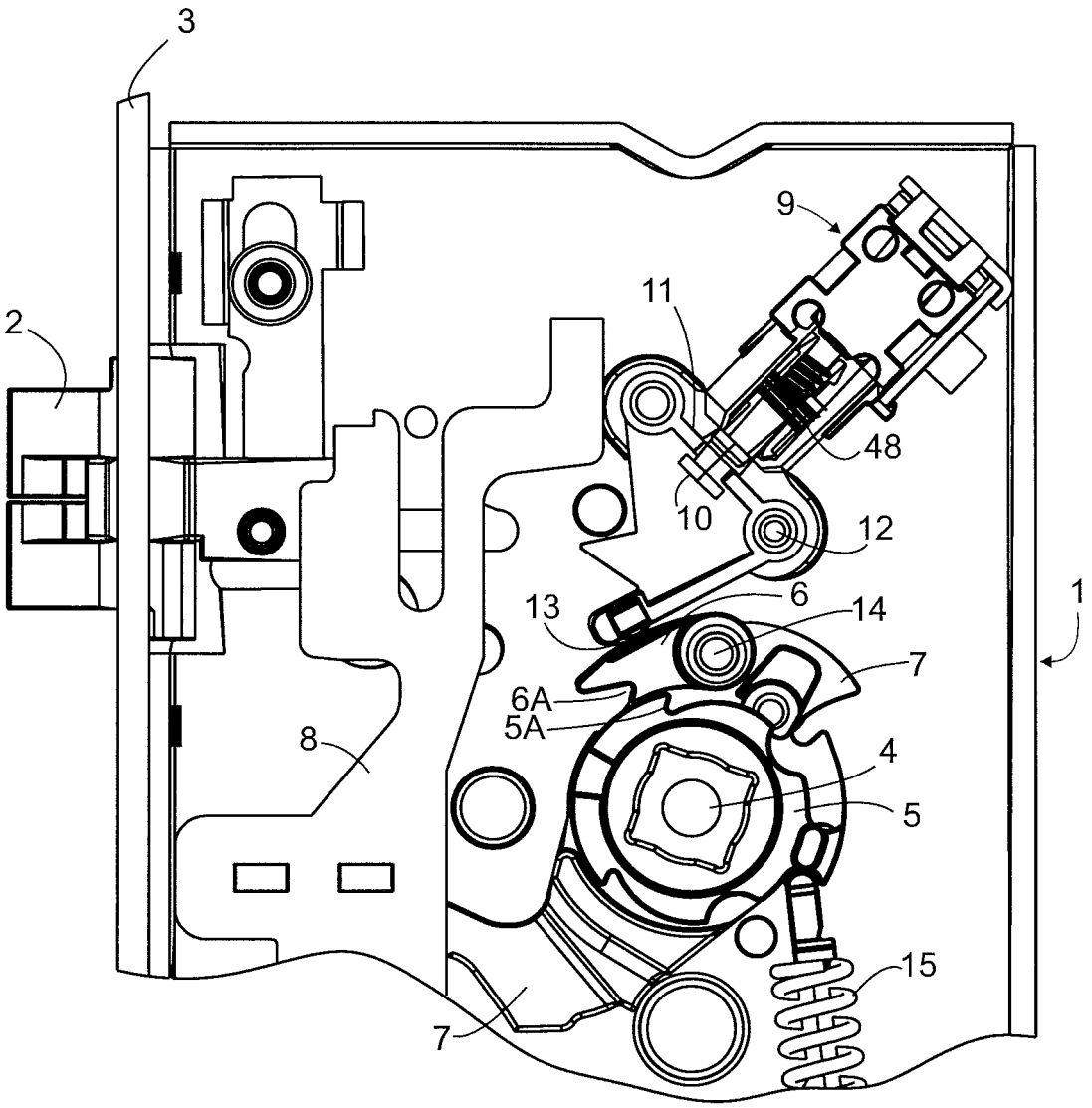
Figure 3:
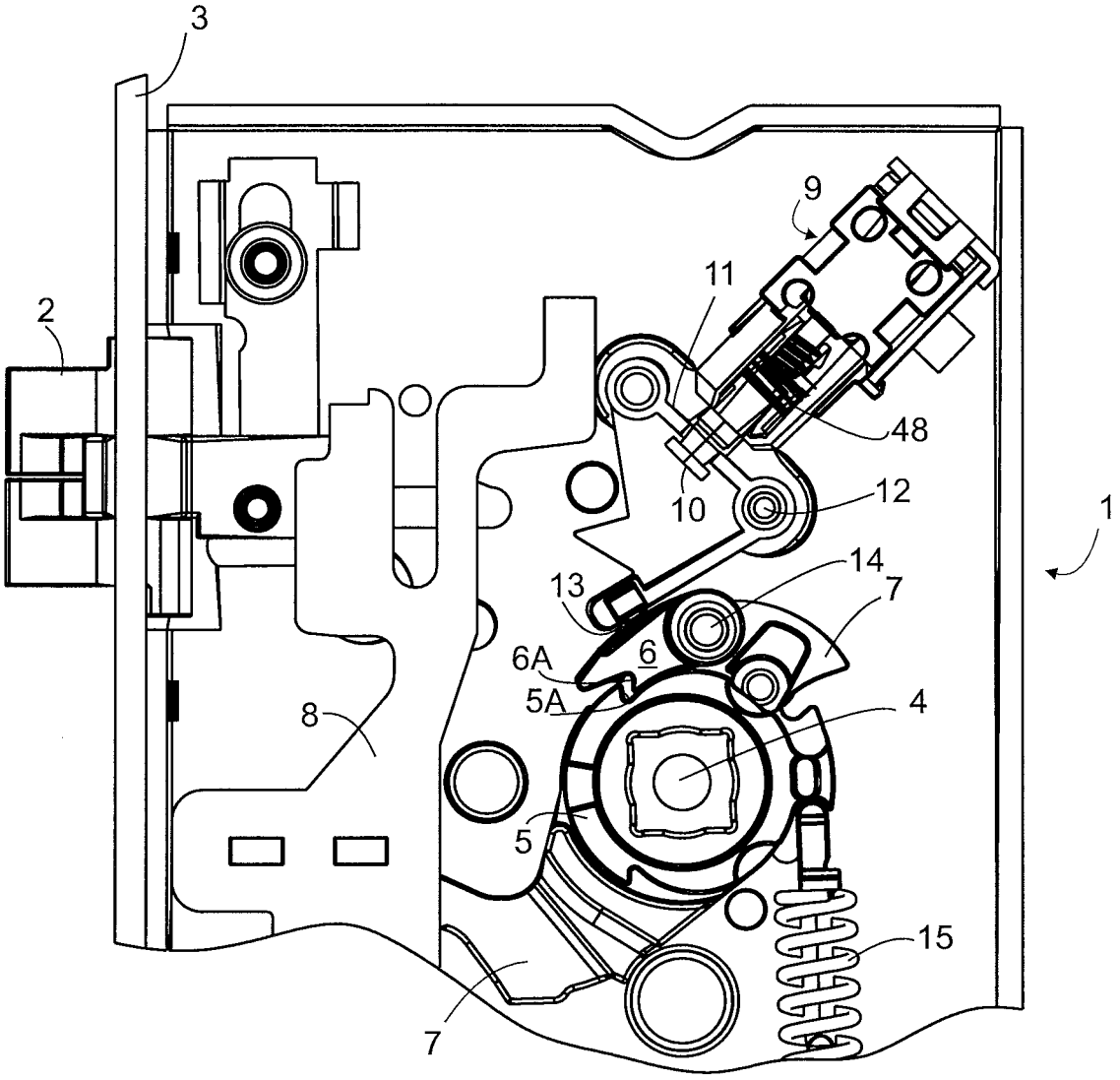
Figure 4:
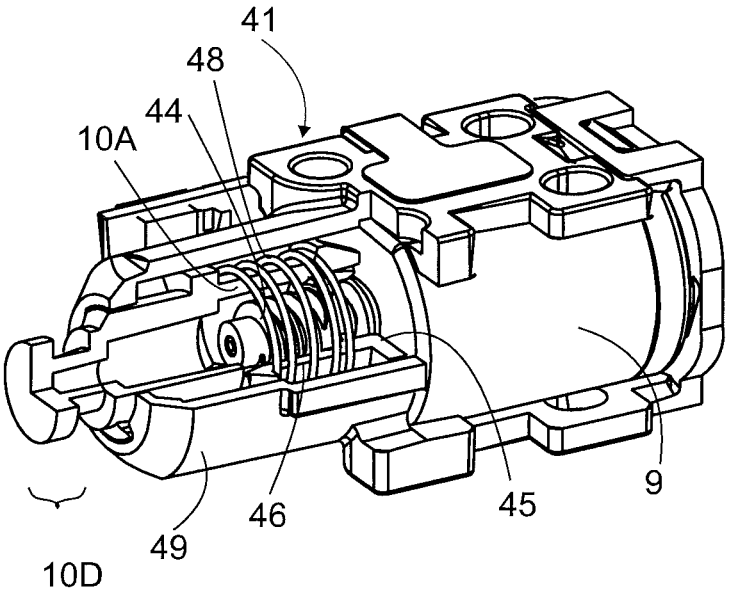
Figure 5:
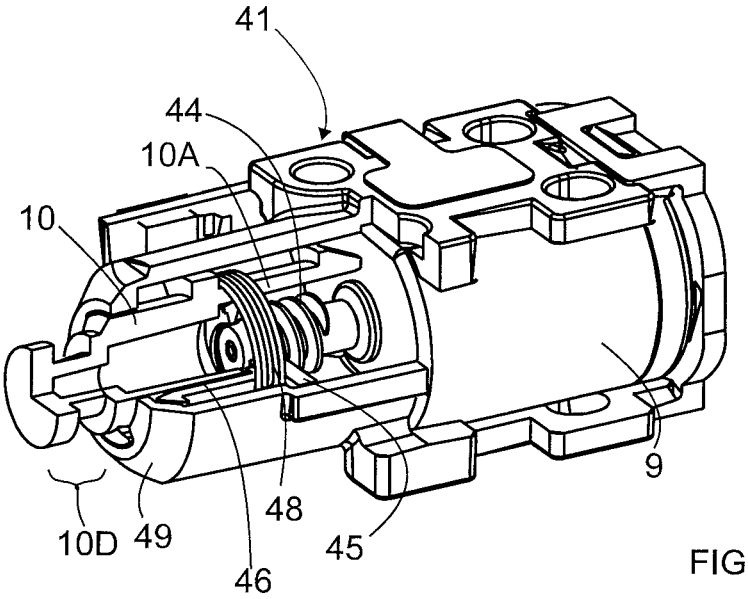
Figure 6:
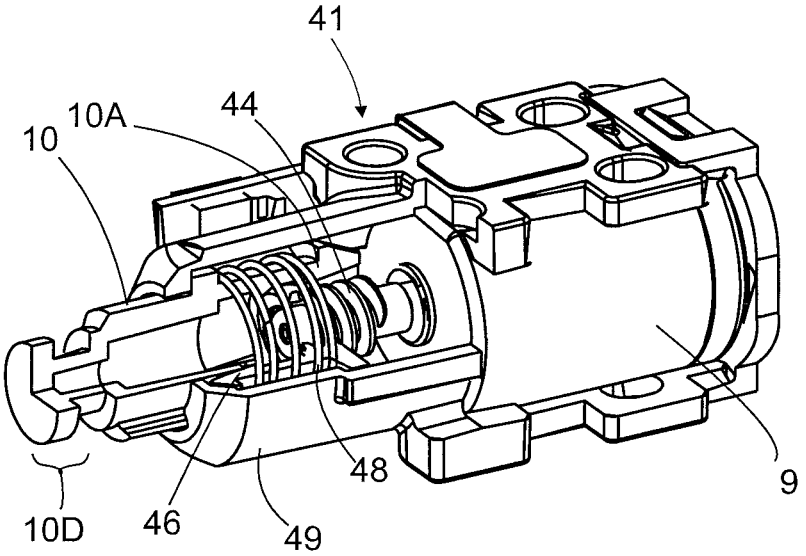
Figure 7:
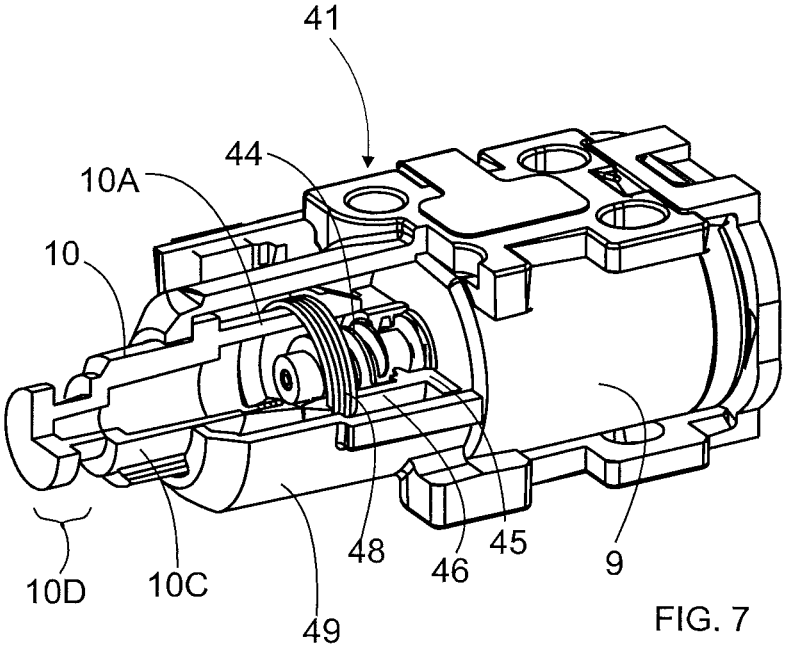
Figure 8:
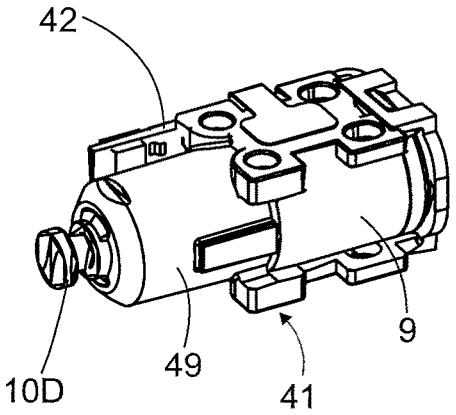
Figure 9:
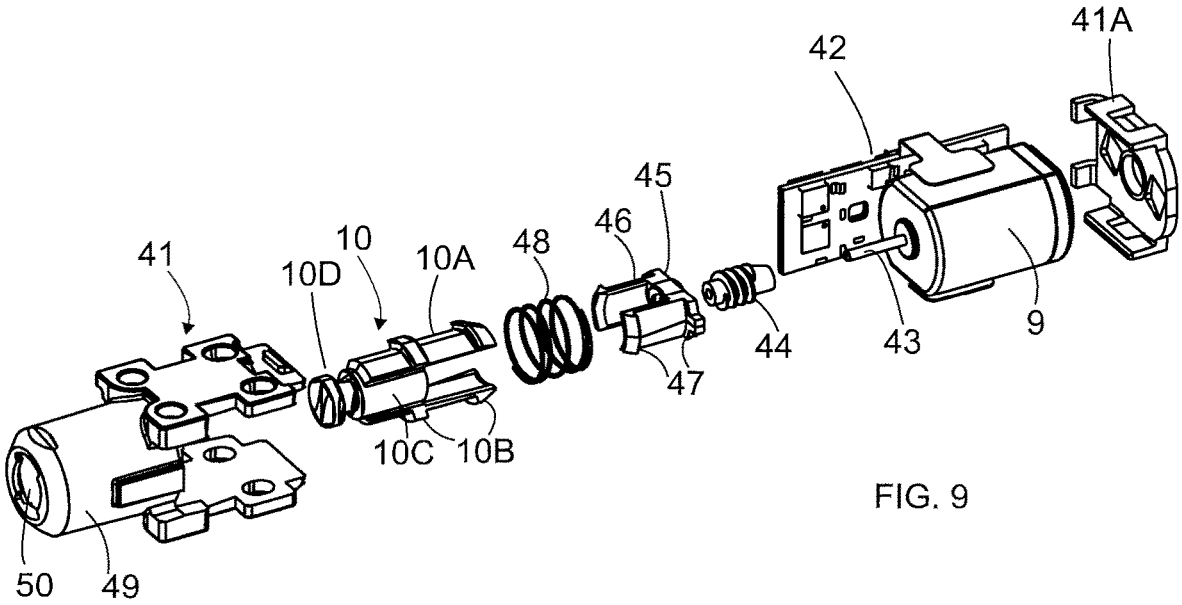
Figure 10:
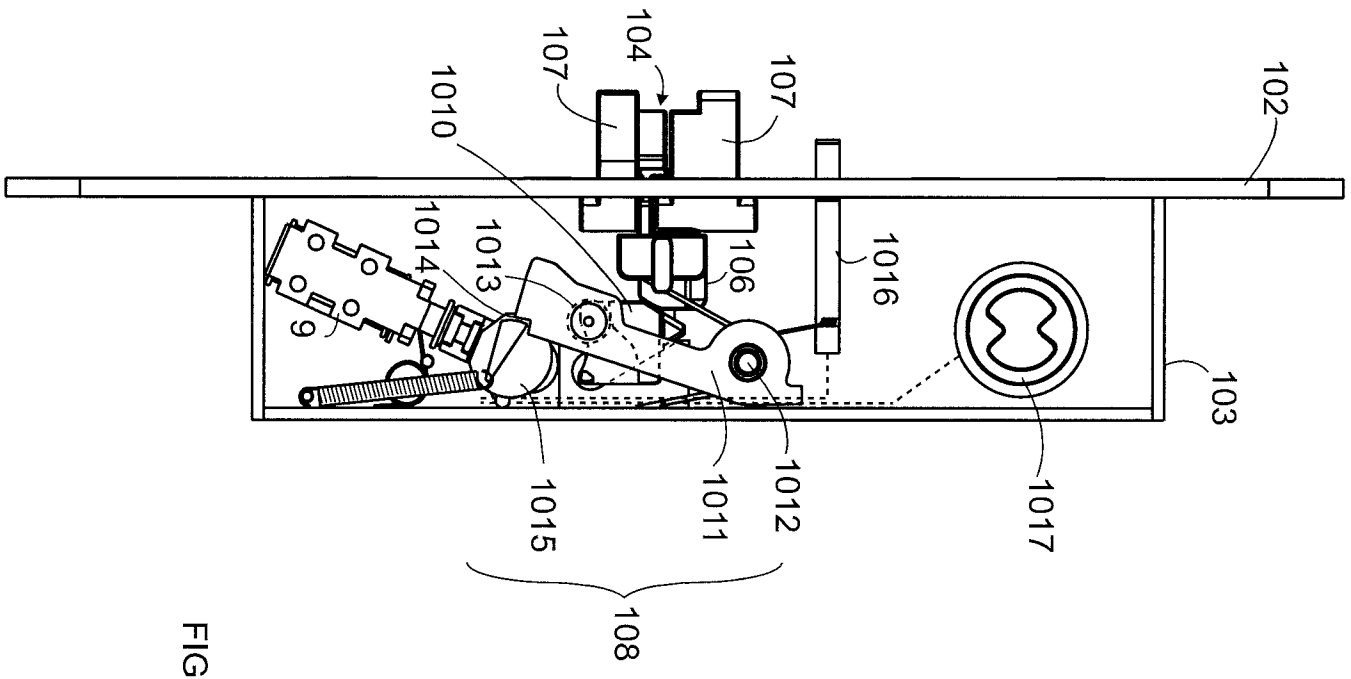

In the following, the invention is described in more detail by means of the accompanying figures, in which FIG. 1 shows an example of the lock body according to the invention, when the driver of the spindle axis of the handle is disconnected from force transfer to the pressure cam, FIG. 2 shows the example of FIG. 1 of the lock body according to the invention, when the driver of the spindle axis of the handle is disconnected from force transfer to the pressure cam, but guided by the electric motor into force transfer, FIG. 3 shows the example of FIG. 1 of the lock body according to the invention, when the driver of the spindle axis of the handle is connected into force transfer with the pressure cam, FIG. 4 shows an example of the electric motor arrangement in the basic state, FIG. 5 shows an example of the electric motor arrangement in a state, in which the piston is guided outwards by the electric motor, but movement of the piston is impeded, FIG. 6 shows an example of the electric motor arrangement in a state, in which the piston is guided outwards by the electric motor and the piston has been able to move outwards, FIG. 7 shows an example of the electric motor arrangement in a state, in which the piston is guided inwards by the electric motor, but the movement of the piston is impeded, FIG. 8 shows an example of the electric motor arrangement when assembled, FIG. 9 shows an example of the electric motor arrangement as an exploded view, and FIG. 10 shows an example of another embodiment of the invention.

DESCRIPTION OF THE INVENTION

FIG. 1 shows an example of the lock body according to the invention, when the driver of the spindle axis of the handle is disconnected from force transfer to the pressure cam. Force transfer is thus, in this example, from the handle to be connected to the lock body via a so-called driver to the locking parts of the bolt. The lock body has various parts, of which only some are shown in FIG. 1 in order to illustrate the invention more clearly. The lock body has a spindle axis 4, which is formed of an axis between a hole (not shown in the figures) at the side of the lock body and the centre point of a recess of the driver 5 in the lock body. The spindle, which is provided with a handle or, for example, a rotary knob, is positioned on this axis 4. When the handle (or rotary knob) is turned, the spindle and driver 5 also turn. On the other side of the lock body, there are possibly a corresponding driver 5 and a hole at the side of the lock body on the same axis. In other words, the spindle axis can be on both sides of the lock body or on just one side of the lock body depending on the type of the lock body. By spindle axis is thus meant, in this connection, the site of the lock body, at which the spindle is positioned.

The driver 5 is arranged in the lock body into the basic position by a spring 15. In this position, the spindle and handle positioned on the spindle axis are also in the basic position. Usually, the handle is horizontal in the basic position, from which it is easy to turn to open the door. If the driver 5 is not in a force transmission connection with the pressure cam 7 in the lock body, the driver turns as the handle is turned, but does not transfer the force of the turn within the lock body. The driver 5 is connected into a force transfer connection by the latch 6. The basic position of the latch 6 is released from the force transfer position, and it is created in the embodiment of the figure by a magnet 13A. The use of a spring is also possible. The electric motor 9 guides via the lever arm or plate 11 the latch 6 into the force transfer position, in which the force transfer surface 6A of the latch is towards the force transfer counter surface 5A of the driver 5. FIG. 3 shows such a situation. If the driver is connected into a force transfer connection with the pressure cam 7, turning the handle causes the pressure cam to turn, which, in turn, moves the locking plate 8 of the bolt 2 or other part in connection with the locking into the "locking opened" position. In this case, the bolt 2 is able to move into the lock body 1 through the bolt hole (not shown in the figures) in the face plate 3 of the lock body. Thus, the strike plate in the frame of the door is able to push the bolt into the lock body as the door is opened.

The electric motor 9 thus guides the lever or plate 11 to turn in relation to its rotational axis (such as a pin) 12. Guiding occurs via the end 10D of the piston 10, which is in connection with the lever or plate 11. In connection with the end 10D of the piston, there is, for example, a transverse groove, which is used to connect the end of the piston to the lever or plate 11. The lever or plate 11 comprises a guiding surface 13, which is against the latch 6. The latch is pivotally connected, for example, via the pin axis 14 to the pressure cam. The pin axis 14 transfers the turning torque of the driver from the latch 6 to the pressure cam 7, when the latch is in the force transfer position.

The electric motor has a spring 48, which performs the guiding action of the electric motor to its termination, if the latch 6 is not able to move into the force transfer position, because the handle is turned simultaneously. FIG. 2 shows such a situation. The guiding of the electric motor 9, i.e. the rotation of its axis in the first direction to move the piston outwards in relation to the electric motor, moves the end 10D of the piston away from the electric motor, wherein the lever or plate 11 seeks to turn and, in turn, to turn the latch 6 into the force transfer position. Because the driver 5 is in the turned state, the latch 6 is not able to move into the force transfer position; instead it is against the outer edge of the driver. The spring 48 has, in this state, stored potential energy.

FIG. 3 shows a situation, in which the turning of the driver 5 from the spindle axis (such as by the handle and spindle) has terminated and the spring 15 has returned the driver 5 to the basic position. In this case, the energy stored in the spring 48 is able to push the piston 10 outwards, wherein the end 10D of the piston guides the lever or plate 11 to turn such that the guiding surface 13 pushes the latch 6 into the force transfer position. If the handle is turned in this state, the turning of the driver 5 turns the pressure cam 7, which, in turn, moves the locking plate 8.

FIG. 4 shows the electric motor arrangement in its basic position, i.e. in this text in the position, in which the piston 10 has moved inwards towards the electric motor 9. FIG. 8 also shows the electric motor arrangement in the basic position, but without the section. FIG. 9 shows an example of the exploded view of the electric motor arrangement. The electric motor is placed into the installation rack 41, through which the electric motor is attached to the lock body 1 (FIGS. 1-3). In the example of the figures, the installation rack also comprises an end piece 41A. In connection with the electric motor, there is usually a circuit board 42, which receives the electrical energy fed to the electric motor and the guiding commands of the electric motor 9.

The electric motor 9 has an axis 43, onto which is attached a worm screw 44. Against the threads of the worm screw, there is a threaded counterpart 45 such that its threading is on the threads of the worm screw 44. When the axis 43 of the electric motor is rotated in the first direction, the worm screw 44 also rotates, which, in turn, guides the counterpart 45 away from the electric motor. The piston 10 is in connection with the counterpart 45, which also seeks to move away from the electric motor. When the axis 43 of the electric motor is rotated in the other direction, i.e. the electric motor now guides in the other direction, the worm screw 44 also rotates, which, in turn, guides the counterpart 45 towards the electric motor. The piston 10 in connection with the counterpart also seeks to move towards the electric motor 9.

The counterpart 45 has at least two vanes 46 facing away from the electric motor 9. At both ends of the vanes 46, the vane projections 47 of the counterpart are facing away from the axis 43 of the electric motor. The piston 10 has at least two vanes 10A of the piston facing towards the electric motor 9. At both ends of the vanes 10A of the piston, the projections 10B of the vanes of the piston are facing away from the axis 43 of the electric motor. The vanes 46 of the counterpart and the vanes 10A of the piston are overlapping and surrounded by a spring 48, which is further between the vane projections 47 of the counterpart and the projections 10B of the vanes of the piston.

In the embodiment of the figures, the shaft of the piston 10 has in its longitudinal direction grooves 10C for the vanes 46 of the counterpart. Thus, the overlapping of the counterpart 45 and the piston 10 against each other is better guided. The piston also has above said end 10D of the piston. The vanes 47 of the counterpart and the open ends of the vanes 10A of the piston can be bevelled, as is shown in the figures. Bevelled open ends facilitate the setting of the spring 48 into place.

The installation rack may comprise a cylinder portion 49, which is open at the first and second ends, wherein a closed installation space is achieved within the cylinder. In the examples of the figures, the cylinder portion 49 contains the axis 43 of the electric motor, the worm screw 44, the counterpart 45, the spring 48 and the piston 10 such that the end 10D of the piston is outside the cylinder via the hole 50 of the first end of the cylinder. The hole 50 of the first end of the cylinder can correspond in shape to the profile of the shaft of the piston. Thus, movement of the piston in the direction of the axis 43 of the electric motor receives support and guiding ability also from the cylinder portion 49.

The basic position of FIG. 4 is thus a state, in which the counterpart 45 is guided towards the electric motor, wherein the piston 10 is also moved inwards towards the electric motor 9. The sections of FIGS. 4-7 illustrate, how the vanes 46 of the counterpart 45 and the vanes 10A of the piston 10 overlap. When the electric motor guides the counterpart 45 and the piston 10 outwards (i.e. rotates the axis 43 in the first direction), but the movement of the piston is impeded (due to pressing of the handle as is described above), the spring 48 compresses and stores potential energy. FIG. 5 shows such a situation. The guiding of the electric motor can terminate and the counterpart 45 remains at the site shown in FIG. 5. When the impediment (the turning of the handle) to moving the piston 10 is removed, the potential energy stored in the spring 48 pushes the piston outwards, wherein the state in FIG. 6 is achieved. The state in FIG. 6 is also the state, into which the piston 10 is able to move guided by the electric motor as the movement of the piston is not impeded.

FIGS. 1-3 show an embodiment, in which the outward movement of the piston 10 guides the latch 6 into a force transfer connection, but it is also possible to implement another type of embodiment, in which movement of the piston 10 towards the electric motor, i.e. inwards, guides the latch 6 into a force transfer connection. In such an embodiment of the lock body, the driver 5 of the lock body 1 is connected into a force transfer connection, when the electric motor 9 guides the piston 10 and its end 10D towards the electric motor from the position of FIG. 6 (the electric motor rotates the axis 43 in the other direction). If the handle is, however, pressed simultaneously, then the driver 5 is not able to move into a force transfer connection as described above. Then, in this case, the counterpart 45 moves towards the electric motor 9 and the spring 48 compresses, storing potential energy, but the piston 10 does not move towards the electric motor. FIG. 7 shows such a situation. When the impediment (such as turning of the handle) to moving the piston is removed, the spring 48 pushes the piston 10 inwards, i.e. towards the electric motor 9. The piston moves into the state shown in FIG. 4.

Because the spring functions symmetrically, the electric motor arrangement can be used in many types of lock bodies, as was above already suggested. One spring is easier to install than two springs. Additionally, the spring 48 of the solution according to the invention is larger than prior springs in connection with the axis 43 of an electric motor. Placement of the spring to the outside of the vanes of the counterpart 45 and the piston 10 has made this possible. Additionally, the spring is easy to install on top of the vanes. The possibility of installing the springs incorrectly is considerably smaller in the solution according to the invention than in the prior known solution. Thus, the possibility of causing in the spring an undesired state of tension is considerably smaller in the invention. Additionally, one spring is as strong as it acts in both directions, whereas providing an action using two springs that is symmetrically equally strong in both directions is significantly more difficult. From the description above, it can be observed that the vane projections 47 of the counterpart and the projections 10B of the vanes of the piston guide the spring 48 as needed to compress, as well as guide the potential energy of the spring to either push the piston 10 inwards or outwards. Additionally, it can be stated that the rigidity of the spring 48 is adequate to maintain the spring in the balanced state, when the piston is able to move unimpeded guided by the electric motor. In this case, the spring 48 is not compressed down, instead the piston moves, while the counterpart 45 moves.

The lock body 1 according to the invention thus comprises a bolt 2, spindle axis 4 of the handle and, placed in connection with it, a driver 5 and a pressure cam 7. The lock body further comprises an electric motor 9, which is arranged to guide the forming and removing of a force transmission connection between the driver 5 and the pressure cam 7 to transfer force or impede force transfer from the spindle axis 4 of the handle to the locking parts 8 of the bolt 3. Depending on the embodiment of the lock body, the locking parts comprise at least one part.

The lock body 1 has, attached to it, an installation rack 41, into which the electric motor 9 is placed. The electric motor has an axis 43, to which is attached a worm screw 44, and which lock body 1 further comprises a threaded counterpart 45 and a piston 10. The threaded counterpart 45 is against the worm screw 44 and movable by the electric motor 9 in the direction of the axis 43 of the electric motor, and the piston 10 is in connection with the counterpart.

The counterpart 45 has at least two vanes 46 facing away from the electric motor 9, at both ends of which vanes are vane projections 47 of the counterpart facing away from the axis of the electric motor. The piston 10 has at least two vanes 10A of the piston facing towards the electric motor 9, at both ends of which vanes 10A of the piston are projections 10B of the vanes of the piston facing away from the axis 43 of the electric motor 9. The vanes 46 of the counterpart 45 and the vanes 10A of the piston are overlapping and surrounded by a spring 48, which is further between the vane projections 46 of the counterpart and the projections 10A of the vanes of the piston.

The piston 10 is arranged to move in the direction of the axis 43 of the electric motor 9, sliding in relation to the counterpart 45 and its vanes 46. The spring 48 is arranged to store potential energy during the guiding state of the electric motor 9, wherein the movement of the piston 10 is at least partially impeded, the driver 5 being turned from the spindle axis 4 of the handle, and which potential energy, when the piston 10 is able to move as the turning from the spindle axis of the driver 5 has terminated, either pushes the piston 10 away from the electric motor 9 or towards the electric motor 9 depending on the type of said lock body. The types of the lock body mean different embodiments of a lock body, such as, for example, an embodiment, in which the outward movement of the piston guides above said latch 6 to form a force transfer connection between the driver 5 and the pressure cam 7, and another embodiment, in which the inward movement of the piston guides above said latch 6 to form a force transfer connection between the driver 5 and the pressure cam 7.

FIG. 10 shows an example of another embodiment according to the invention. The force transfer is, in this example, between the bolt and the deadbolting piece in the lock body via the parts belonging to the deadbolting means. The lock body 103 comprises a face plate 102 and a dual-action bolt 104, which is movable in a back and forth linear movement between the retracted position and the extracted from the lock body locking position through the bolt hole in the face plate 102. The bolt 104 comprises a stem part 106 and, in the embodiment of FIG. 10, two bolt pieces 107. The bolt 104 is spring-loaded in the direction of said extracted position. The lock body further comprises deadlocking means 108, which are movable into the deadlocking position, in which they impede moving of the dual-action bolt from the extracted position into the retracted into the lock body 103 position. The lock of the embodiment of FIG. 10 further comprises an electric motor 9, which is arranged to guide the forming and removing of a force transmission connection between the stem part 106 of the bolt and the deadlocking piece 1015 of the bolt belonging to the deadlocking means to transfer force or to impede force transfer from the bolt 102 to the deadlocking piece 1015 of the bolt.

The door lock can also comprise other guiding means to guide the deadlocking means. The lock can have an auxiliary bolt 1016 and/or a spindle guidance equipment 1017. The auxiliary bolt impedes the bolt from moving into deadlocking, when the door is open, but allows it, when the door is closed. The spindle guidance equipment 1017 comprises, for example, a keyhole, a handle and/or a rotary knob. The connection of the spindle guidance equipment and the auxiliary bolt with the locking piece 1015 of the deadlocking means is marked simply by dashed lines.

The deadlocking means comprise a wedge 1010 between the stem part 106 of the bolt and the lock body 103. The wedge is arranged to move transversely in relation to the linear path of the bolt. The deadlocking means further comprise a locking piece 1015 and a lever 1011, which comprises a support point 1012, support surface 1013, locking surface 1014. The lever 1011 is pivotally supported into the lock body 103 at the support point 1012. The support surface 1013 is arranged to cooperate with the wedge 1010.

The support surface 1013 and the locking surface 1014 are to be turned along with the lever in relation to the support point 1012 between the extracting position of the lever in the direction of the face plate and the retracting position of the lever in the direction of the rear edge of the lock body. The locking surface 1014 is further away from the support point 1012 than the support surface 1013. The lever 1011 is spring-loaded in the direction of the extracting position.

The locking piece 1015 is movable against the locking surface 1014 to lock the lever and the wedge into the deadlocking position, in which deadlocking position the lever 1011 is in the extracting position and the support surface 1013 is against the wedge 1010, and the wedge is wedged between the stem 106 of the bolt and the lock body 103. The electric motor 9 guides the deadbolting piece 1015 either into a force transmission connection via the lever 1011 of the bolt 104 or out from the force transmission connection. In the force transmission connection, the deadbolting piece is against the locking surface 1014 of the lever and impedes the bolt 104 from moving into the lock body. The bolt is thus deadlocked. The force transmission connection is removed, when the deadbolting piece is moved by the electric motor 9 such that the deadbolting piece 1015 is no longer against the lever and its locking surface 1014.

If the door is pushed or pulled open, while seeking to remove the deadlocking by the electric motor, the lever 1011 can sink against the locking surface 1014 of the deadbolting piece 1015 with such force that the electric motor is not able move the deadbolting piece into the opened position. In other words, an external force can push the dual-action bolt into the lock body with such force that the deadbolting piece 1015 jams. In this case, the movement of the piston 10 is at least partially impeded. Once the force being the directed onto the door has ceased, only then is the piston able to move. The spring 48 is, in this case, able to move the piston by the potential energy stored by the spring. The cessation of the force directed onto the door means, in this connection, that it ceases enough that the deadbolting piece is able to move.

As was already stated above, a lock body according to the invention is easier to assemble and less expensive, because installation of the electric motor is easier. Installation of one spring is faster and easier and, at the same time, the amount of required parts has been reduced. The installation of one spring also does not create damages as easily as in prior solutions. Because the construction of the solution enables the use of a larger spring than in the past and only one spring, the greater potential forces of a spring are provided, and the action of the spring is symmetrical in both directions. This significantly facilitates the assembly of various lock body types. Moreover, the construction according to the invention has also increased the travel distance of the piston, wherein the electric motor arrangement is suitable for various lock body solutions. A half millimeter increase in the travel distance of the piston is already a significant improvement, which the invention realizes. Additionally, the cylinder portion 49 of the installation rack, as for it, facilitates installability and protects the parts from possibly getting dirty. Moreover, the solution according to the invention can be implemented between any whatsoever parts in a lock body to be arranged into a force transmission connection, so that the impeded situations/fault situations of the types described above can be managed.

The examples described above do not contain or do not show all the parts that the lock body contains in order that the invention could be presented more clearly. It is nonetheless obvious to the skilled person in the art, which parts the lock body comprises, such as, for example, the bolt hole in the face plate of the lock body. To the skilled person in the art it is also obvious that the electric motor 9 receives guidance command, for example, from a pushbutton or an identifier travelling along with the user, who is recognized and who has the rights to use the lock body. The electrification of the electric motor, for example, by a battery and the guidance signals of the electric motor are thus per se already known.

In light of the examples presented above, it is obvious that the embodiment according to the invention can be achieved by many various solutions. For example, some embodiments may have more than two vanes 46 of the counterpart and also vanes 10A of the piston. The deadlocking means can also be implemented in a different manner than in the examples presented above. The invention is thus not limited only to said examples, rather it can be implemented by various embodiments within the scope of the independent claim.

The invention claimed is:

1. A lock body comprising a bolt and parts to be arranged in a force transmission connection, in which the lock body further comprises an electric motor, which is arranged to guide the forming and removing of a force transmission connection between said parts to transfer force or to impede force transfer, where the electric motor and force transmission connection define a guiding state of operation of the lock body, in which the lock body has, attached to it, an installation rack, into which an electric motor is placed, in which the electric motor has an axis, to which is attached a worm screw, and in which the lock body further comprises a threaded counterpart and a piston, in which the threaded counterpart is threadingly engaged with the worm screw and movable by the electric motor in the direction of the axis of the electric motor, and the piston is in connection with the counterpart, wherein the counterpart has at least two vanes facing away from the electric motor, where at both ends of the counted part the vanes include vane projections of the counterpart facing away from the axis of the electric motor, and the piston has at least two vanes of the piston facing towards electric motor, where at both ends of the piston the vanes of the piston include projections of the vanes of the piston facing away from the axis of the electric motor, in which the vanes of the counterpart and vanes of the piston are overlapping and both the vanes of the counterpart and vanes of the piston are surrounded by a spring, in which the spring is mounted so as to provide a bias between the vane projections of the counterpart and the projections of the vanes of the piston, in which the piston is arranged to move slidable in the direction of the axis of the electric motor, thereby sliding in relation to the counterpart and its vanes, and in which the spring is arranged to store potential energy during the guiding state of the electric motor, wherein the movement of the piston is at least partially impeded by the bias of the spring from the stored potential energy, and when the piston is able to move as said impeding terminates, the biased of the spring either pushes the piston away from the electric motor or towards the electric motor.

2. The lock body according to claim 1, wherein the lock body also comprises a spindle axis of the handle, and said parts to be arranged in a force transmission connection are a driver and pressure cam placed in connection with the spindle axis of the handle, wherein the electric motor is arranged to guide the forming and removing of a force transmission connection between the driver and the pressure cam to transfer force or to impede force transfer from the spindle axis of the handle to the locking parts of the bolt, and which spring is arranged to store potential energy during the guiding state of the electric motor, wherein the movement of the piston is at least partially impeded, the driver being turned from the spindle axis of the handle, and which potential energy, when the piston is able to move as the turning of the driver from the spindle axis terminates, either pushes the piston away from the electric motor or towards the electric motor.

3. The lock body according to claim 1, wherein said parts to be arranged in a force transmission connection are the stem part of the bolt and the deadlocking piece of the bolt, wherein the electric motor is arranged to guide the forming and removing of a force transmission connection between the stem part of the bolt and the deadlocking piece of the bolt to transfer force or to impede force transfer from the bolt to the deadlocking piece of the bolt, and which spring is arranged to store potential energy during the guiding state of the electric motor, wherein the movement of the piston is at least partially impeded as an external force directed onto the bolt seeks to move the bolt into the lock body and which potential energy, when the piston is able to move as said external force terminates, either pushes the piston away from the electric motor or towards the electric motor.

4. The lock body according to claim 1, wherein the rigidity of the spring is adequate to maintain the spring in the balanced position, when the piston is able to move unimpeded guided by the electric motor.

5. The lock body according to claim 1, wherein the shaft of the piston has in its longitudinal direction grooves for the vanes of the counterpart.

6. The lock body according to claim 4, wherein the open ends of the vanes of the counterpart and the vanes of the piston are bevelled.

7. The lock body according to claim 4, wherein the installation rack comprises a cylinder portion, which is open at the first and second ends, which cylinder portion contains an axis of the electric motor, a worm screw, a counterpart, a spring and a piston, which piston comprises an end, which is outside the cylinder portion via a hole of the first end of the cylinder.

8. The lock body according to claim 7, wherein the hole of the first end of the cylinder corresponds in shape to the profile of the shaft of piston.

9. The lock body according to claim 1, wherein there is a circuit board in connection with the electric motor.

* * * * *